US005117943A

United States Patent [19]

Schmitt et al.

[11] Patent Number: 5,117,943

[45] Date of Patent: Jun. 2, 1992

[54] RUNG LOCK ASSEMBLY FOR AN EXTENSION LADDER

[75] Inventors: Thomas J. Schmitt; Claude R. Wallick, Jr., both of Jefferson County, Ky.

[73] Assignee: Emerson Electric Co., St. Louis, Mo.

[21] Appl. No.: 765,568

[22] Filed: Sep. 25, 1991

[51] Int. Cl.[5] ..... E06C 7/06

[52] U.S. Cl. ..... 182/213

[58] Field of Search ..... 182/209, 210, 211, 212, 182/213

[56] References Cited

U.S. PATENT DOCUMENTS

| | | | |
|---|---|---|---|
| 369,084 | 8/1887 | Smith | 182/213 |
| 437,395 | 9/1890 | Flynn | 182/212 |
| 565,750 | 8/1896 | Hill | 182/213 |
| 613,848 | 11/1898 | Seagrave | 182/213 |
| 802,017 | 10/1905 | Newton | 182/213 |
| 1,806,185 | 5/1931 | Skeels | 182/213 |
| 2,310,441 | 2/1943 | Klum | 182/213 |
| 4,299,306 | 11/1981 | Hawkins | 182/210 |

FOREIGN PATENT DOCUMENTS

| | | | |
|---|---|---|---|
| 748515 | 5/1956 | United Kingdom | 182/213 |

*Primary Examiner*—Reinaldo P. Machado
*Attorney, Agent, or Firm*—Polster, Lieder Woodruff & Lucchesi

[57] ABSTRACT

A rung lock assembly for selectively and releasably locking a pair of adjacent rungs of relatively slidable fly ladder and base ladder sections of an extensible ladder including a rung lock frame pivotally mounted within the fly ladder section to be normally urged into engagement with adjacent rungs of the ladder sections and a pulley and cable system cooperative with the rung lock frame to release and move the same away from such engagement for relative slidable movement of the ladder sections.

14 Claims, 3 Drawing Sheets

RUNG LOCK ASSEMBLY FOR AN EXTENSION LADDER

BACKGROUND OF THE INVENTION

The present invention relates to extension ladders and more particularly to a novel rung lock assembly for releasably locking of preselected stations adjacent rungs of relatively slidable ladder sections.

It has been long known in the ladder arts to broadly use rung locks for adjusting extension ladders to a desired length. Attention is directed to the long since expired U.S. Pat. No. 369,084, issued to J. E. Smith on Aug. 30, 1887. This long expired patent teaches a "clutch lever or rung lock pivotally mounted on a ladder fly section to be manipulated by a rope and pulley assembly located on the outer rail face of the ladder base section to lockingly engage any one of several selected spaced rungs on the base section only of the ladder. To allow locking, the rope of the assembly which is tied off to the rung lock must be fully released at a selected stage of operation in a comparatively complex and a comparatively undependable operation. Attention further is directed to long since expired U.S. Pat. No. 437,395, issued to J. J. Flynn on Sep. 30, 1890, which teaches a complex guide and crank arrangement to move one ladder section relative an adjacent section with a unitary pair of spaced "dogs" or rung locks pivotally mounted on the fly section also to lockingly engage any one of several selected spaced rungs on the base section only of the ladder. Individual lips engageable against the rails of the fly section limit movement of the "dogs" or rung locks and a separate rope independent of the fly section moving crank rope, disposed intermediate the spaced rails of the base section is utilized to release the rung lock unitary pair of spaced "dogs". Long expired U.S Pat. No. 565,750, issued to B. A. Hill on Aug. 11, 1896, teaches what appears to be a rocker rung lock mounted on the base or fixed section of a ladder, the spaced fingers of the rung lock being actuated by a moving rope into and out of engagement only with rungs of the fly or sliding section of the ladder. The relatively moveable ladder sections appear to be movable directly by hand. U.S. Pat. No. 613,848, issued to F. S. Seagrave on Nov. 8, 1898 teaches a rung lock normally suspended intermediate to and out of engagement of the ladder rungs which when in locked rung position can be pulley operated out of such position to the normally disengaged position. The long since expired U.S. Pat. No. 802,017, issued to F. T. Newton on Oct. 17, 1905, which also appears to be movable directly by hand also includes a rope questionably actuated rung lock. In this patent, the rung lock is mounted on the fly section of the ladder with the tension of the rope acting as a spring to pivot or rock the lock into urged engagement with a rung on the base section. A latch pivotally suspended from the rung lock serves to prevent rung engagement during downward movement of the fly section. British patent No. 748,515 to C. W. Catless, published May 2, 1956, teaches a rung lock which is pivotally mounted on said base section which depends on gravity and a separate rope passing along an outside face of a ladder fly section and through the rung lock with the tension of the rope causing pivotal movement of the rung lock and movement of the fly section. Finally, U.S. Pat. No. 4,299,306, issued to H. G. Hawkins on Nov. 10, 1981, teaches a rung lock frame, a portion of which is similar in geometry to the present invention, but which overall structure operates in a different manner. In accordance with the rung lock assembly of the present invention, a structure is provided which is straightforward, efficient and economical to manufacture and assemble, which requires a minimum of operational parts and yet allows for the ready and efficient releasable rung locking and moving of relatively slidable telescoping ladder sections of an expansible ladder in an operating manner readily, efficiently and smoothly controlled with a minimum of steps and with a minimum of binding by a sole operator and user with a single comparatively non-interfering cable. In addition, the features of the present invention can be employed with extension ladders of more than two sections and which utilize rungs of various cross-sectional configurations. Moreover, the present invention provides for a readily operable rung lock assembly with its several parts confined within the limits of the spaced ladder rails without unnecessarily restricting movement of personnel in various positions of ladder use. In addition, the present invention provides a novel modification wherein a portion of the operating cable extends in longitudinal fashion between relatively slidable ladder sections and is connected to a pivotal rung lock frame to pivot such frame with applied force at a position substantially adjacent the longitudinally extending cable portion, and substantially in spaced lateral relation to the apex located pivot point for such rung lock frame, eliminating the need for a cable guide adjacent the pivoted rung lock frame.

Various other features of the present invention will become obvious to one skilled in the art upon reading the disclosure set forth herein.

BRIEF SUMMARY OF THE INVENTION

More particularly the present invention provides in combination with an extension ladder having at least two adjacent and relatively slidable ladder sections, each of which includes a plurality of spaced rungs normally extending between and fastened to a pair of spaced ladder rails, one of the ladder sections serving as a base ladder section and the other serving as a moveable fly ladder section, an improved rung lock assembly for selectively and releasably locking a pair of adjacently positioned rungs of the relatively slidable ladder sections comprising: rung lock frame means pivotally suspended between the pair of spaced rails of the fly ladder section, the frame means including a mouth portion geometrically sized and configured to releasably engage both of a pair of adjacently positioned rungs of the relatively slidable fly and base ladder sections; means cooperative with the frame means to normally urge the mouth portion thereof into releasable engageable locking position with adjacent rungs of the relatively slidable ladder sections; pulley means journalled on the base ladder section within opposed inner faces of the spaced rails; and, preselectively sized cable means longitudinally extending over the pulley means in looped fashion within the opposed inner faces of the spaced rails of the base ladder section with one extremity of the cable means connected to the fly ladder section and the opposite extremity to a position on the rung lock means whereby longitudinal movement of the looped cable means provides longitudinal movement of the fly ladder section and lateral movement of the looped cable means allows for positive pivotal movement of the rung lock frame means away from the path of engagement with the spaced rungs of the base ladder section. In addition, the present invention provides a unique modification to locate a longitudinally extending portion of the cable within the relatively moveable ladder sections to allow for a more direct pivoting force action of the rung lock frame.

It is to be understood that various changes can be made by one skilled in the art in one or more of the several parts of the assembly disclosed without departing from the scope or spirit of the present invention. For example, the several parts of the assembly can be made from any one of a number of known materials and the mouth configuration can be varied in accordance with the rung cross-sectional configuration.

BRIEF DESCRIPTION OF THE DRAWINGS

Referring to the drawings which disclose one advantageous embodiment of the present invention.

DETAILED DESCRIPTION OF THE DRAWINGS

Figure 3:
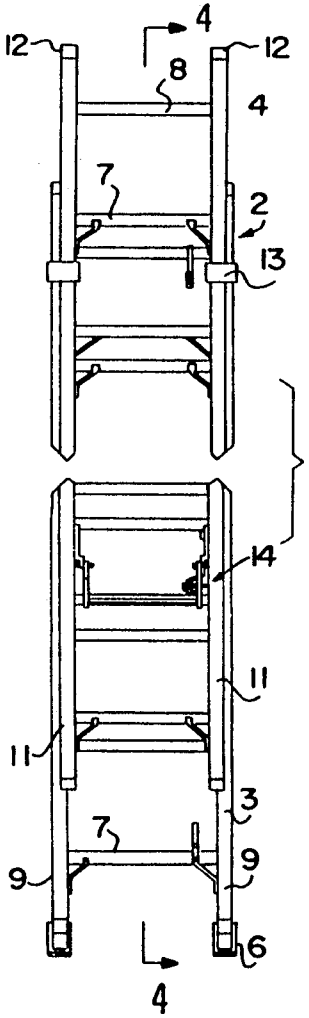
FIG. 3 is a front view of the expansible ladder of FIG. 1 with the fly and base ladder sections in a selected expanded position.

Referring to FIGS. 1–4 of the drawings, an expansible or extension ladder 2 is disclosed as including two ladder sections, one of which constitutes the base ladder section 3 and the other the fly ladder section 4. Suitable shoes 6 having non-skid soles or tracks are pivotally mounted to the lowest extremities of the spaced longitudinally extending rails of the base ladder section 3. In this regard, each of the ladder sections 3 and 4 includes a plurality of spaced rungs 7 and 8 respectively, normally extending between and fastened to pairs of spaced rails 9 and 11 respectively. As aforenoted, base ladder section 3 is provided with non-skid shoes 6 pivotally mounted at the bottom of rails 9 and each rail can be provided with suitable rounded corner rail end caps 12 at the opposite extremities thereof. As known in the art, fly ladder section 4 is slidably moveable relative base ladder section 3 with suitable spaced rail guide brackets 13 being mounted at the upper portion of base ladder section rails 9 to slidably receive the outer face of fly ladder section rails 11. It is to be understood that in accordance with the present invention, more than the two ladder sections, as shown, can be employed. Advantageously, the ladder sections can be formed from a suitable light weight metal such as aluminum, but other materials such as fiberglass, foam or wood can be utilized and, although the rungs 7 and 8 as disclosed are of circular cross-section, it is to be understood that other cross-sectional rung shapes, such as those with "D" cross-sections, can be employed. Mounted on the inner faces of rails 11 of fly ladder section 4 is the novel rung assembly 14 which includes pivotally mounted frames 16 and the cable and pulley assembly 17.

Figure 4:
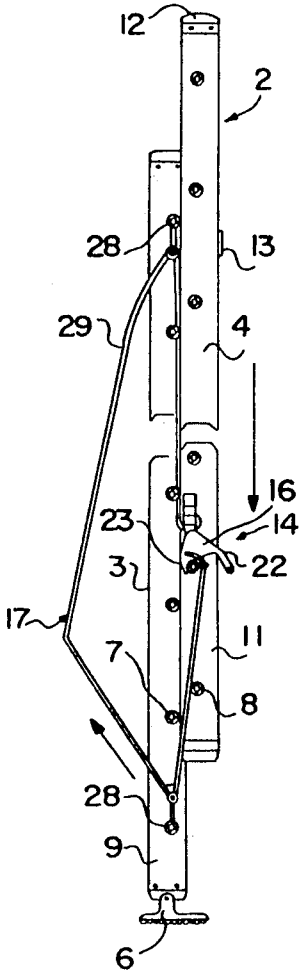
FIG. 4 is a cross-sectional side view taken in a plane through line 4—4 of FIG. 3; disclosing the rung lock frame pivoted out of rung lock engaging position.
Figure 2:
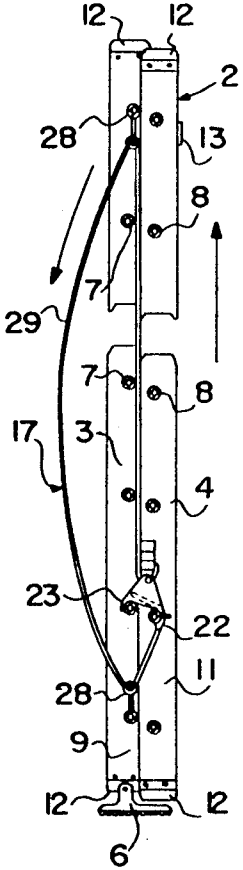
FIG. 2 is a cross-sectional side view taken in a plane through line 2—2 of FIG. 1 disclosing the rung lock frame in rung lock engaging position.
Figure 1:
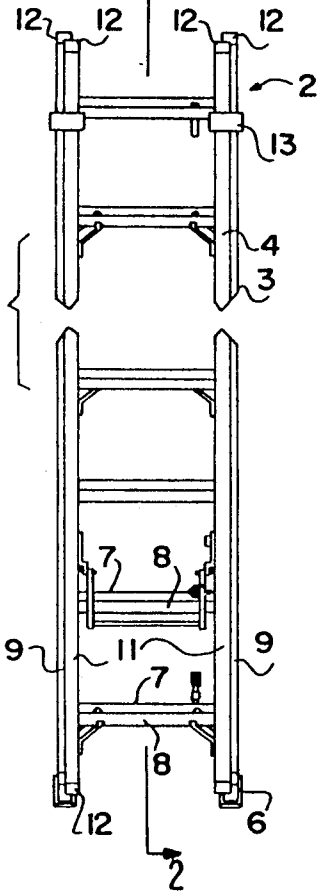
FIG. 1 is a front view of the expansible ladder incorporating the inventive rung lock assembly with the fly and base ladder sections, in contracted position.
Figure 5:
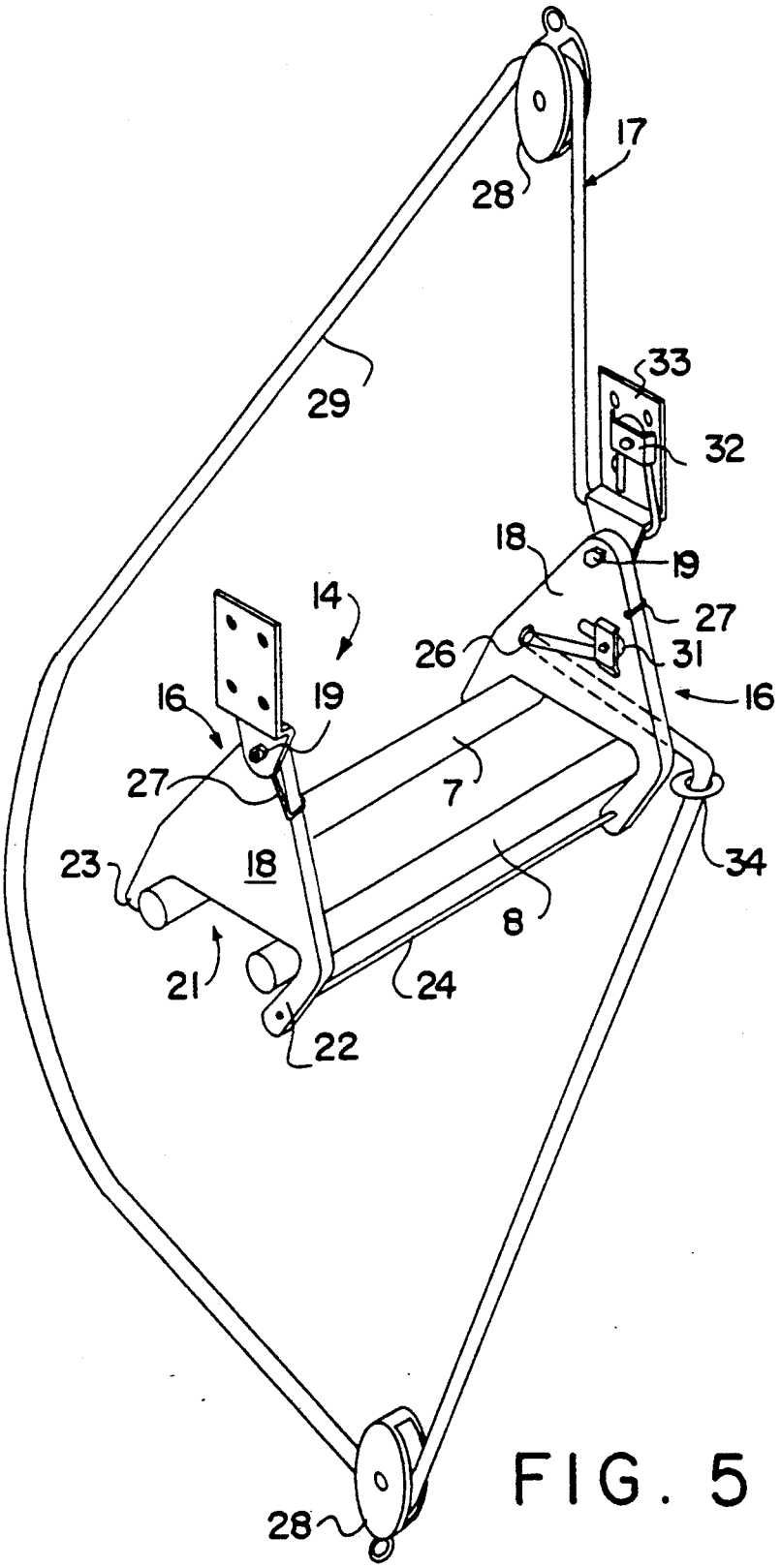
FIG. 5 is an enlarged schematic isometric view of the rung-lock assembly of FIGS. 1–4 in engagement with adjacent fly and base ladder section rungs.

Referring to FIG. 5 of the drawings which discloses the rung lock assembly 14 in more detail, it can be seen that it includes spaced, mirror image rung lock frames 16. These spaced frames 16, each have a triangular-like shaped upper portion 18 which is pivotally mounted at the apex thereof to the inner faces by a pivot pin 19 which serves as a pivot axis and is fixed to the inner face of one of two fly ladder section rails 11 of the fly ladder section 4 (see FIGS. 1–4 of the drawings). These frames 16 advantageously also can be made of a suitable light weight aluminum material and are geometrically shaped to include spaced downwardly extending spaced lower projection portions or fingers to provide two spaced mirror-image mouth 21 determining pairs of lower projection portions 22 and 23 with projection pair portions 22 being connected by a cross-bar 24 so that the spaced mirror image rung-lock frames 16 act as a unit with one pair 22 of the lower projections which determine mouth 21 serving to embrace opposed ends of a preselected rung 8 of fly ladder section 4. The other pair of lower projections 23 are geometrically configured to releasably engage the ends of an adjacently positioned base ladder rung 7 of the base ladder section 3, as can be seen in FIGS. 2 and 5 of the drawings. In this regard, as can be seen in FIG. 4 of the drawings, the outer edge faces of frames 16 adjacent lower projection pair 23 when in rung released position from a base ladder rung 7 of base ladder section 3 are geometrically so configured to be relatively moveable or slideable with respect to spaced base ladder rungs 7 of base ladder section 3. It is to be noted that the unit forming pair of rung lock frames 16 are geometrically so configured and balanced with respect to the center of gravity location relative the pivotal apeces of the triangular portions about pivot pins 19 that the mouth 21 formed by spaced lower projection pairs 22 and 23 pivots toward normally locking position with respect to adjacent base rungs 7 and fly rungs 8 of the relatively slidable ladder sections 4 and 3. It further is to be noted (FIG. 5) that one of frames 16 has a cable receiving aperture 26 therein located in the frame above and proximately adjacent the edge of one of the pair of lower projections 23 which is adapted to releasably engage a preselected rung 7 of the base ladder section 3.

As can be seen in FIG. 5, a pair of torsional springs 27 can be mounted on the spaced inner faces of rails 11 of the fly ladder section 4 to grip the outer edges of frames 16 to urge the rung lock frames 16 toward the normally locked position with adjacently positioned base ladder rung 7 and fly ladder rung 8.

To manually move the fly ladder section 4 relative the base ladder section and to pivotally release the rung lock section and to pivotally release the rung lock assembly 14 from a normally engaged position with a preselected pair of adjacent base ladder and fly ladder rungs 7 and 8, a pair of looped cable supporting, spaced pulleys 28 are journalled at the upper and lower portions of the inner face of the base ladder section rail 9, advantageously on the upper and lower rungs 7 to be positionable adjacent that frame 16 having cable receiving aperture 26 therein. A cable 29 which advantageously can be in the form of an appropriately sized flexible braided nylon rope is looped about the spaced sheaves of pulleys 28 to extend along the inner face of a base ladder rail 9. As can be seen in FIG. 5, one extremity of cable or rope 29 extends through aperture 26 in rung lock frame 16 to be fastened to such frame 16 by a rope clamp 31. The other extremity of cable 29 is fastened to the inner face of the rail 11 of fly ladder section 4 by a rope clamp 32 fastened to a mounting bracket 33 which, in turn, is fastened to the inner face of fly ladder rail 11 of fly ladder section 4.

It is to be noted that a cable or rope guide means which can be in the form of a suitable eye screw 34 also can be fastened to the inner face of fly ladder rail 11 of fly ladder section 4 at a preselected position adjacent rope aperture 26 in frame 16 to limit operational interference. With this cable or rope arrangement 29, the longitudinal movement of rope or cable 29 causes relative slidable movement to base ladder section 3 of fly ladder section 4, to which the cable ends are fastened. With a lateral movement of rope 29, the rung lock assembly 14 and its spaced frames 16 can be pivoted from releasable otherwise normally locked engagement with adjacent base and fly rungs 7 and 8.

Figure 7:
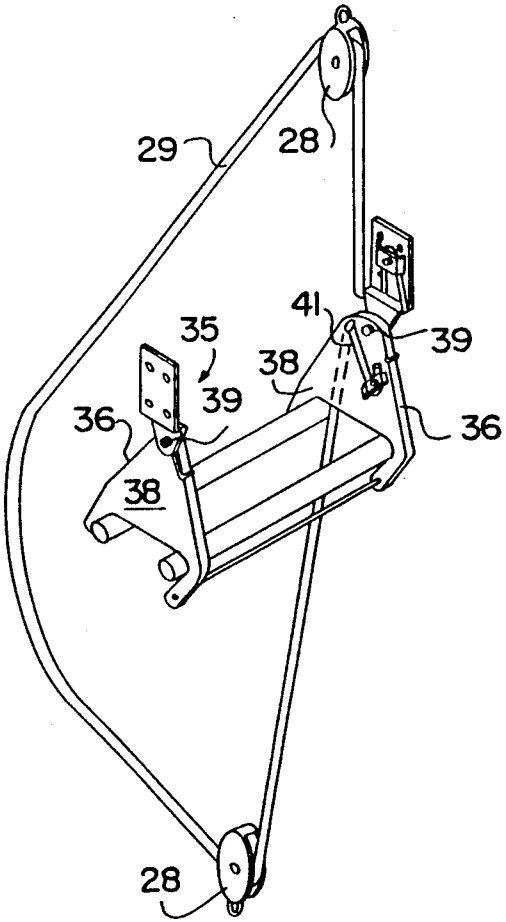
Figure 6:
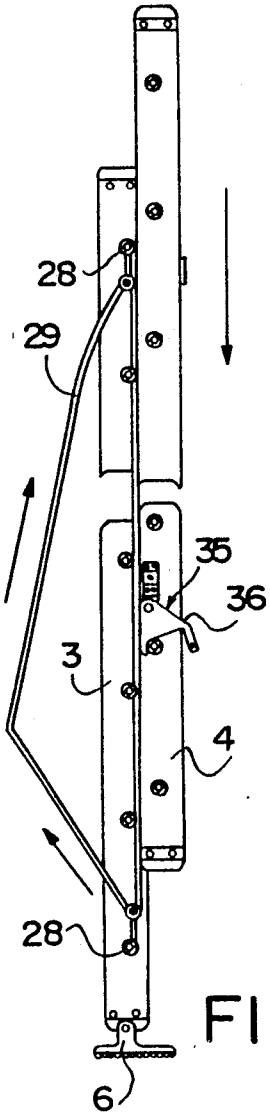
FIG. 6 is a cross-sectional side view similar to the view of FIG. 4 disclosing an inventive modification that provides for a relocated cable connection to one of the rung lock frames allowing more direct pivoting force on the rung lock frames, eliminating the need for a cable guide adjacent the frame; and, FIG. 7 is an enlarged schematic isometric view similar to that of FIG. 5, disclosing in more detail the modification of FIG. 6.

In accordance with a modified feature of the present invention, as is disclosed in FIGS. 6 and 7 of the drawings, it is possible to utilize a portion of the operating cable extending in longitudinal fashion between the relative slidable ladder sections in a manner similar to that of FIG. 4 in a connection to a slightly modified rung lock frame with an apex portion of greater breadth to pivot such frame with a force applied at a position substantially adjacent or in line with the longitudinally extending cable portion and substantially in spaced lateral relation to the apex located pivot point for such rung lock frame, eliminating the need for a cable eye guide 34 adjacent the rung lock frame. As can be seen in FIG. 6, the base section 3, fly section 4, sheaves 28 and cable in 29 are substantially like that disclosed in FIGS. 1–4 of the drawing. The principal modification is in the rung lock assembly 35 and particularly in the spaced rung lock frames 36, as can be seen more clearly in FIG. 7. Mirror-image frames 36, like aforedescribed frames 16, each have a triangular-like shaped upper portion 38 which is pivotally mounted at the apex thereof to the inner faces of fly section 4 by a pivot pin 39 which serves as a pivot axis and is fixed to the inner face of one of two fly ladder section rails 11 of the fly ladder section 4—all in a manner of assembly like that described for the structure of FIGS. 1–4. The difference rests in the greater breadth of triangular upper portion 38 which allows for relocation of the cable receiving aperture, here designated by reference numeral 41. This aperture 41 is so positioned as to be laterally spaced from pivot 39 and substantially in line with the longitudinally extending portion of cable 29 which extends between the relatively movable ladder sections 3 and 4. Thus, in this modification as disclosed in FIGS. 6 and 7, the rung lock frames 36 can be pivoted out of locked engagement in a positive manner with the pivoting force being substantially aligned with the in-line movement of the longitudinally extending cable portion of cable 29 without requiring a guide ring 34 and with a comparative minimum of effort and wear.

Thus, with the abovedescribed novel rung lock assembly, it is possible to extend and retract an extension ladder in a positive rung lock engaging and releasing operation with a minimum of operating ladder parts and with a minimum of operating steps.

The invention claimed is:

1. In combination with an extension ladder having at least two adjacent and relatively slidable ladder sections, each of which includes a plurality of spaced rungs normally extending between and fastened to a pair of spaced ladder rails, one of said ladder sections serving as a base ladder section and the other serving as a moveable fly ladder section, an improved rung lock assembly for selectively and releasably locking a pair of adjacently positioned rungs of said relatively slidable ladder sections comprising:

rung lock frame means pivotally suspended between the pair of spaced rails of said fly ladder section, said frame means including a mouth portion geometrically sized and configured to releasably engage both of a pair of adjacently positioned rungs of said relatively slidable fly and base ladder sections;

means cooperative with said frame means to normally urge said mouth portion thereof into releasably engageable locking position with preselected adjacent rungs of said relatively slidable ladder sections;

pulley means journalled on said base ladder section within opposed inner faces of said spaced rails; and, preselectively sized cable means longitudinally extending over said pulley means in looped fashion within said opposed inner faces of said spaced rails of the base ladder section with one extremity of said cable means connected to said fly ladder section and the opposite extremity to a preselected position on said rung lock frame means whereby longitudinal movement of said looped cable means provides longitudinal movement of said fly ladder section and lateral movement of said looped cable means allows for positive pivotal movement of said rung lock frame means away from the path of engagement with the spaced rungs of said base ladder section.

2. The rung lock assembly of claim 1, said pulley means including a pair of spaced pulley sheaves journalled at opposite end portions of said base ladder section.

3. The rung lock assembly of claim 1, said rung lock frame means being pivotally connected at its upper portion from the inside face of at least one of said spaced ladder rails of said fly ladder section.

4. The rung lock assembly of claim 1, said rung lock frame means having a center of gravity preselectively positioned relative its location of pivotal suspension so that said mouth portion thereof pivots toward normally locked position with adjacent rungs of said base ladder section.

5. The rung lock assembly of claim 1, said cable means having at least one end thereof fastened to said rung lock frame means.

6. The rung lock assembly of claim 1, said cable means having opposite ends thereof preselectively fastened at spaced locations relative said rung lock frame means.

7. The rung lock assembly of claim 1, and guide means preselectively cooperative with said fly ladder section to guide said cable means to limit operational interference with the pivotal movement of said rung lock means.

8. The rung lock assembly of claim 1, said rung lock frame means having spring means cooperative therewith to pivotally urge said mouth portion into normally releasable engagement with adjacently positioned rungs of said relatively slidable ladder sections.

9. The rung lock assembly of claim 1, said rung lock frame means including a downwardly extending projection for containing said mouth portion thereof in engaged releasable position with adjacently positioned rungs of said relatively slidable ladder sections.

10. The rung lock assembly of claim 1, said rung lock frame means including an upper portion pivotally mounted on a pivot axis fastened to said fly ladder section of said ladder and including two downwardly extending spaced mouth defining lower projection portions, one of which forms a guideway to embrace a preselected rung of said fly ladder section with said spaced mouth defining lower projecting portions being geometrically configured so that said mouth therebetween can releasably engage an adjacent rung of said base ladder section.

11. The rung lock assembly of claim 1, said rung lock frame means including a pair of spaced frames, each having two spaced lower projections to engage adjacent rungs of said ladder sections, one of said frames having a rope receiving aperture therein positioned adjacent an edge of one of two lower projections in said same adapted to releasably engage a preselected rung of the base ladder section.

12. The rung lock assembly of claim 11, and rope guide means fastened to the inner face of said rail of said fly ladder section adjacent said rope aperture in said frame whereby longitudinal movement of said rope causes relative movement of said fly and base ladder sections and lateral movement causes pivotal movement of said frame unit.

13. The rung lock assembly of claim 1, a portion of said cable means longitudinally extending between said relatively slidable ladder sections with said opposite extremity of said cable means connected to said pivotal rung lock means applying a force thereon at a position substantially in line with said longitudinally extending cable and laterally spaced from the pivot point thereof.

14. In combination with an extension ladder having at least two adjacent and relatively slidable ladder sections, each of which includes a plurality of spaced rungs normally extending between and fastened to a pair of spaced ladder rails, one of said ladder sections serving as a base ladder section and the other serving as a moveable fly ladder section, an improved rung lock assembly for selectively and releasably locking a pair of adjacent rungs of said relatively slidable ladder sections comprising:

a rung lock including a pair of spaced mirror image rung lock frames having triangular-like shaped upper portions pivotally mounted at the apex thereof to a pair of opposed pivot axes fixed to the inner faces of said spaced ladder rails of said fly ladder section, said triangular-like shaped upper portions including spaced downwardly extending lower projection portions to provide two spaced mirror image mouth determining pairs of lower projection portions with one of said lower projection pairs being connected by a cross-bar so that said spaced mirror-image frames act as a unit with one pair of the lower projections determining said mouth serving to embrace opposed ends of a preselected rung of said fly ladder section and the other pair of said lower projections being geometrically configured to releasably engage the ends of an adjacently positioned preselected rung of said base ladder section with the outer edge faces thereof when in rung released position extending proximate and relatively moveable with respect to the spaced rungs of said base ladder sections; said unit forming pair of rung lock frames being further geometrically configured and balanced relative the pivotal apices of the triangular portions thereof to have a center of gravity positioned relative said apices that said mouth portion formed by said frames pivots toward normally locked position of adjacent rungs of said relatively slidable ladder sections, one of said frames having a rope receiving aperture therein positioned in the triangular-like upper portion of the frame at the apex in lateral relation to the pivot point of said frame and above of one of the pair of lower projections adapted to releasably engage a preselected rung of the base ladder section;

a pair of torsional springs mounted on said spaced rails of said fly ladder section adjacent the pivotal apeces of said frames to further urge said frames toward said normally locked position;

a pair of spaced pulleys journalled at the upper and lower portions of the inner face of that rail of said base ladder section positionable adjacent that frame having a rope receiving aperture therein;

a preselectively sized rope looped about said spaced pulleys to have a longitudinally extending portion extending between said relatively movable ladder sections and along the inner face of the rail of that base ladder section with one extremity thereof substantially aligned with and extending through said rope aperture in said frame and being fastened to said frame and the other extremity being fastened to the inner face of the rail of said fly ladder section.

* * * * *